US006607095B2

(12) United States Patent
Bernard et al.

(10) Patent No.: US 6,607,095 B2
(45) Date of Patent: Aug. 19, 2003

(54) MODULE FOR TRANSFERRING MAILPIECES BETWEEN A FOLDING/ INSERTING MACHINE AND A FRANKING MACHINE

(75) Inventors: Emmanuel Bernard, Sannois (FR); François Coste, Chennevieres sur Marne (FR)

(73) Assignee: Neopost Industrie, Bagneux (FR)

( * ) Notice: Subject to any disclaimer, the term of this patent is extended or adjusted under 35 U.S.C. 154(b) by 25 days.

(21) Appl. No.: 10/043,093

(22) Filed: Jan. 14, 2002

(65) Prior Publication Data

US 2002/0109288 A1 Aug. 15, 2002

(30) Foreign Application Priority Data

Jan. 26, 2001 (FR) ..... 01 01066

(51) Int. Cl.[7] ..... B65H 9/00; B65H 9/16

(52) U.S. Cl. ..... 221/226; 221/248; 382/101; 705/406

(58) Field of Search ..... 221/275, 226, 221/248; 101/407; 382/101; 705/401, 406

(56) References Cited

U.S. PATENT DOCUMENTS

| | | | | |
|---|---|---|---|---|
| 5,253,863 A | * | 10/1993 | Brewster, Jr. | 271/265.01 |
| 5,493,500 A | * | 2/1996 | Boorsma | 705/406 |
| 5,996,664 A | * | 12/1999 | Gregoire | 156/350 |
| 6,209,860 B1 | * | 4/2001 | Fehringer et al. | 270/45 |
| 6,390,702 B1 | * | 5/2002 | Muller | 400/636 |
| 2002/0063903 A1 | * | 5/2002 | Claviez-Homberg | 358/403 |

FOREIGN PATENT DOCUMENTS

| | | | | |
|---|---|---|---|---|
| JP | 2-8097 | * | 1/1990 | B43L/13/00 |

* cited by examiner

*Primary Examiner*—Donald P. Walsh
*Assistant Examiner*—Kenneth W Bower
(74) *Attorney, Agent, or Firm*—Sughrue Mion, PLLC

(57) ABSTRACT

This invention relates to a transfer module for transporting mailpieces between an exit of a folding/inserting machine delivering a mailpiece at a first upper level in a transverse direction and an entry of a franking machine receiving this mailpiece at a second upper level in a longitudinal direction, this module comprising means for receiving the mailpieces ejected via the folding/inserting machine exit and conveying means for transporting, in a direction D of displacement, these ejected mailpieces towards the franking machine entry, the receiving means and the conveying means being considerably inclined towards this franking machine entry from a low supporting plane of the folding/inserting machine.

6 Claims, 2 Drawing Sheets

MODULE FOR TRANSFERRING MAILPIECES BETWEEN A FOLDING/ INSERTING MACHINE AND A FRANKING MACHINE

FIELD OF THE INVENTION

The present invention relates exclusively to the domain of mail processing, and more particularly to an interface module for the transfer of mailpieces between a folding/inserting machine and a franking machine.

BACKGROUND OF THE INVENTION

Numerous transport or conveyor devices are known in almost all domains of industrial activity. In the specific domain of mail processing, Applicants have already proposed in their French Application No. 99 13981 an adapter module between the exit of a digital printer and the entry of a folding/inserting machine.

On the other hand, no equivalent module exists at the present time between the exit of a folding/inserting machine and the entry of a franking machine. In effect, the documents (closed envelopes) leaving the folding/inserting machine are generally collected in a basket from which they are removed by hand to be transported to a feed station of the franking machine for franking thereof.

This absence of automatization results from the fact that present-day technology in folding/inserting machines imposes that the envelopes exit along their width while that in franking machines involves transport of these envelopes along their length.

It is therefore an object of the present invention to overcome these drawbacks by providing a transfer module intended to ensure automatic transport of mailpieces between a folding/inserting machine and a franking machine. Another object of the invention is to propose a module of simple structure which nonetheless allows it to be adapted to different entry levels of franking machines.

SUMMARY OF THE INVENTION

These objects are attained by a transfer module for transporting mailpieces between an exit of a folding/ inserting machine delivering a mailpiece at a first upper level in a transverse direction and an entry of a franking machine receiving this mailpiece at a second upper level in a longitudinal direction, characterized in that it comprises means for receiving the mailpieces ejected via said folding/ inserting machine exit and conveying means for transporting, in a direction D of displacement, these ejected mailpieces towards said franking machine entry, said receiving means and said conveying means being considerably inclined towards said franking machine entry from a low supporting plane of said folding/inserting machine.

With this inclined configuration of the path of transport of the transfer module of the invention, the mailpieces may leave the folding/inserting machine completely before being entrained by the conveying means. Any jamming, which is inevitable with a device placed directly at the entrance/exit level of the two machines, i.e. with zero or little inclination, is thus avoided.

According to a preferred embodiment, the conveying means are in addition likewise inclined with respect to said direction of displacement of the mailpieces towards a longitudinal guiding wall.

These conveying means preferably comprise an endless conveyor belt driven by a motor and the inclination with respect to said supporting plane of said conveying means is adjustable via a mechanism incorporating an endless screw able to be actuated by hand by an operator from a control button.

The transfer module of the invention advantageously further comprises adjustable stop means for retaining the ejected mailpieces on said receiving means and processing means connected, on the one hand, to circuits controlling said folding/inserting machine and, on the other hand, to circuits controlling said franking machine in order to control said conveying means as a function of the rate of exit of the mailpieces and that of franking of these mailpieces.

BRIEF DESCRIPTION OF THE DRAWINGS

The invention will be more readily understood on reading the following description given by way of non-limiting example, with reference to the accompanying drawings, in which.

DESCRIPTION OF PREFERRED EMBODIMENT

Figure 1:
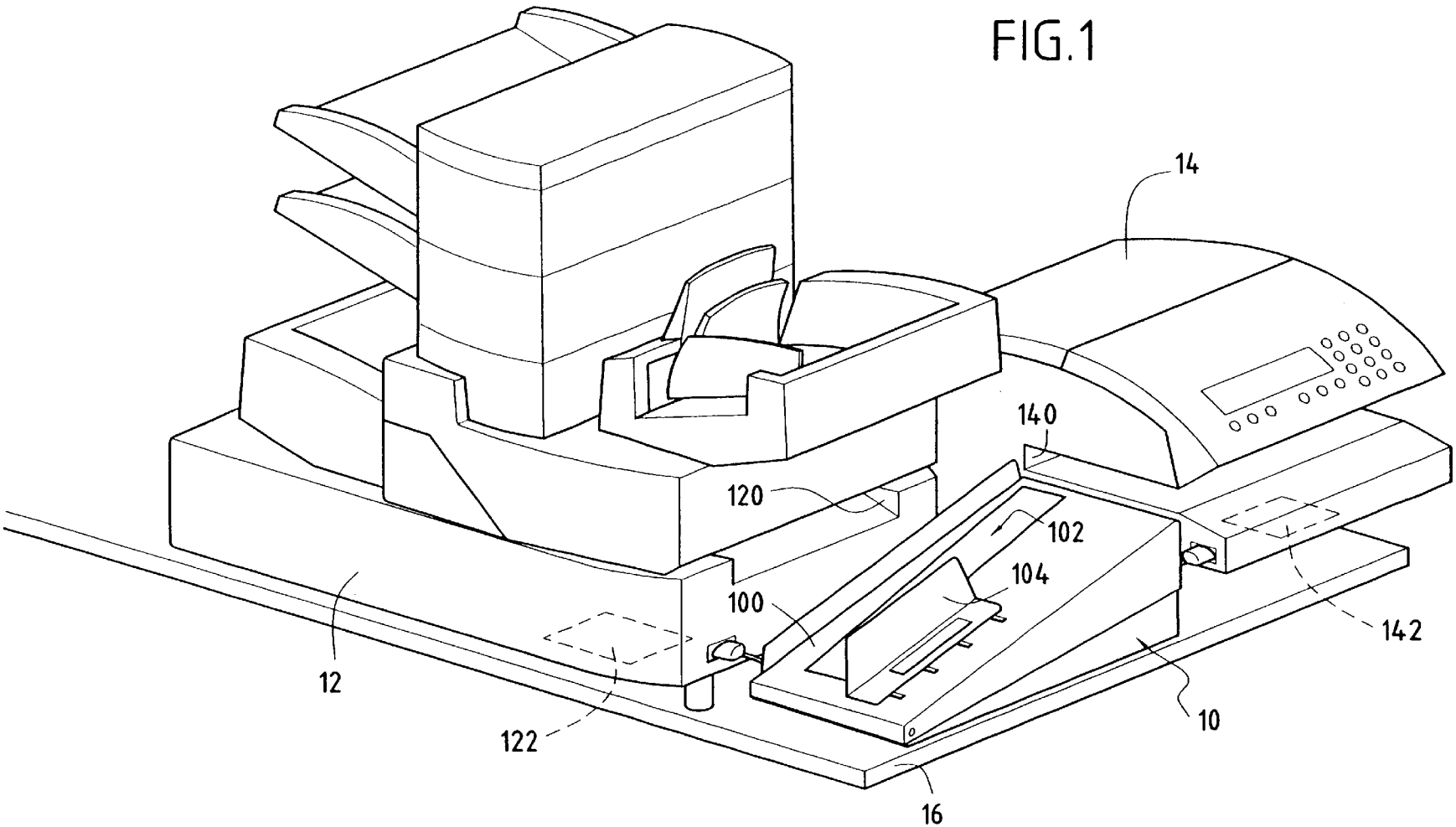
FIG. 1 is a view in perspective of a mail processing assembly incorporating a transfer module according to the invention.

Referring now to the drawings, FIG. 1 illustrates the transfer module 10 of the invention, showing in perspective a mail processing assembly comprising both a folding/ insertion machine 12 and a franking machine 14. The franking machine is disposed perpendicularly with respect to the folding/inserting machine on the same supporting plane 16.

The folding/inserting machine 12 ensures the folding of documents and/or advertizing inserts in empty envelopes and delivers a full, closed envelope at an exit 120. This envelope is ejected from this machine along its width from a first exit level qualified as "high" with respect to a "low" reference level corresponding to the supporting level of the folding/inserting machine (in principle the level of the work plane 16 for the machine operator).

The franking machine 14 effects franking (possibly preceded by weighing) of the closed envelopes introduced via an entry 140 of this machine. These envelopes are received along their length at a second entry level also qualified as "high" with respect to the "low" reference level corresponding to the supporting plane of this franking machine (in principle the same work plane 16 for the operator). In practice, it may be observed that the exit level of the folding/inserting machine and entry level of the franking machine may be located at close levels, i.e. with a slight inclination between these two levels, more exceptionally at a substantially identical level and therefore with zero inclination.

Figure 2:
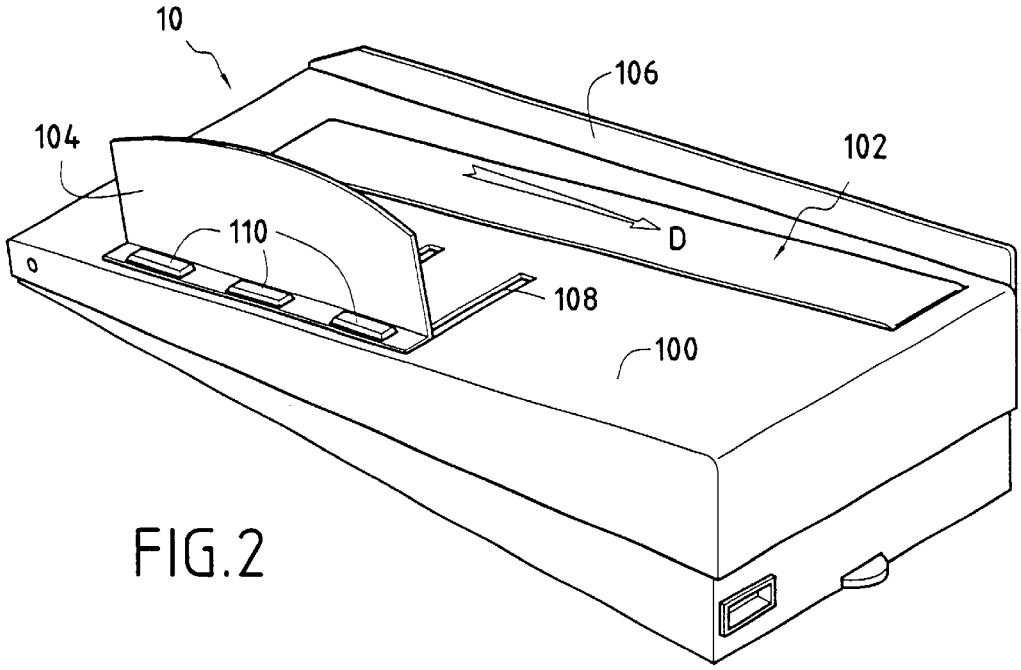
FIG. 2 is an enlarged view of the transfer module of FIG. 1.
Figure 3:
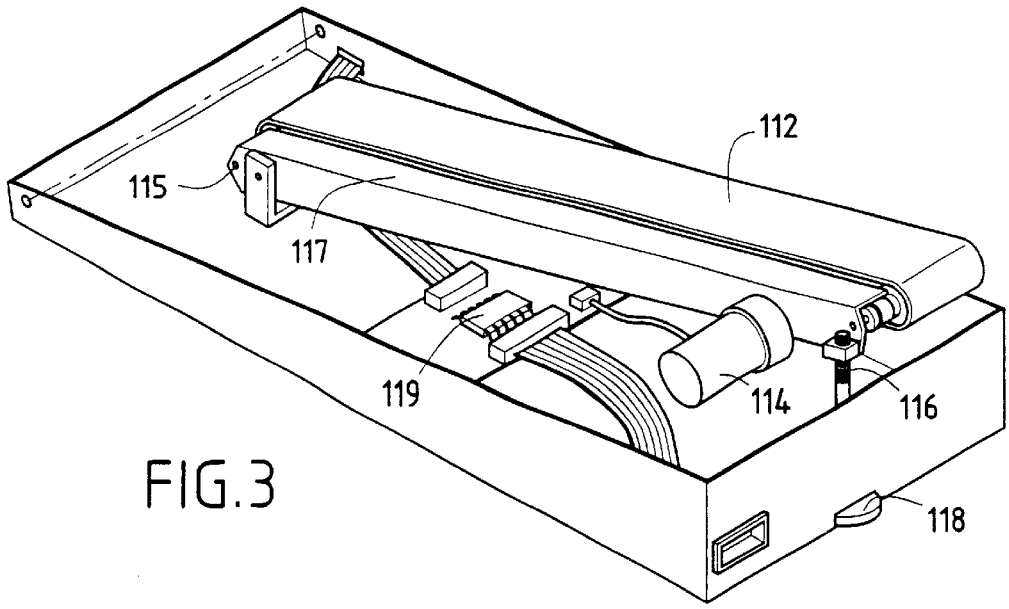
FIG. 3 schematically shows the internal structure of the transfer module of FIG. 1.

According to the invention, the transfer module 10 (illustrated in FIG. 2) for conveying the mailpieces between the exit 120 of the folding/inserting machine 12 and the entry 140 of the franking machine 14 comprises means 100 for receiving mailpieces ejected from this exit of the folding/ inserting machine and conveying means 102 for conveying these ejected mailpieces, in a direction D of displacement, towards the entry of the franking machine. These conveying means are inclined with respect to this direction of displacement of the mailpieces, towards a longitudinal guiding wall 106 of the transfer module, in order to suitably position the mailpieces ejected by the folding/inserting machine.

Adjustable stop means 104 are also provided for retaining the mailpieces on the receiving means after they have been ejected from the folding/inserting machine. They are advantageously constituted by a vertical plate disposed parallel to the guiding wall and able to move in grooves 108, transversely to the direction of displacement of the mailpieces, it being maintained in position very simply for example by one or more magnets 110 mounted on a foot of this plate.

The receiving means, like the conveying means, are considerably inclined from the low reference level of the support 16 of the two machines towards the entry 140 of the franking machine. This considerable inclination avoids any jamming that a connection of zero or slight inclination between these two machines would inevitably involve, as in that case the envelope would be taken along while still being retained in the exit 120 of the folding/inserting machine. This considerable inclination thus allows this envelope to leave the exit of the folding/inserting machine completely before being entrained and directed by the conveying means towards the entry of the franking machine.

According to a preferred embodiment, the conveying means comprise an endless conveyor belt 112 driven by a motor 114. In addition, in order to adapt the transfer module to different entry levels of the franking machine, the inclination of this belt in a vertical plane about a pivot axis 115 is adjustable via an endless screw mechanism 116 adapted to be actuated manually by an operator from a control button 118. The concomitant displacement of the receiving means 100 which rest on an arm 117 supporting the conveyor belt 112 will be noted.

The motor driving the conveyor belt may be controlled simply by hand from a switch of on/off type (not shown), or preferably in synchronism with the functioning of the two machines 12, 14. To that end, the transfer module 10 advantageously comprises processing means 119 (in which case it controls rotation of the motor 114 directly), conventionally connected, on the one hand, to circuits 122 for controlling the folding/inserting machine and, on the other hand, to circuits 142 for controlling the franking machine in order to control the speed of displacement of the conveyor means as a function of the rate of exit and that of franking of the mailpieces.

What is claimed is:

1. Transfer module for transporting mailpieces between an exit of a folding/inserting machine delivering a mailpiece at a first upper level in a transverse direction and an entry of a franking machine receiving this mailpiece at a second upper level in a longitudinal direction, wherein it comprises means for receiving the mailpieces ejected via said folding/inserting machine exit and conveying means for transporting, in a direction D of displacement, these ejected mailpieces towards said franking machine entry, said receiving means and said conveying means being considerably inclined towards said franking machine entry from a low supporting plane of said folding/inserting machine.

2. The transfer module of claim 1, wherein said conveying means are in addition likewise inclined with respect to said direction of displacement of the mailpieces, towards a longitudinal guiding wall.

3. The transfer module of claim 1, wherein said conveying means comprise an endless conveyor belt driven by a motor.

4. The transfer module of claim 1, wherein said inclination with respect to said supporting plane of said conveying means is adjustable via an endless screw mechanism adapted to be actuated by hand by an operator from a control button.

5. The transfer module of claim 1, wherein it further comprises adjustable stop means for retaining the ejected mailpieces on said receiving means.

6. The transfer module of claim 1, wherein it further comprises processing means connected, on the one hand, to circuits for controlling said folding/inserting machine and, on the other hand, to circuits for controlling said franking machine in order to control said conveying means as a function of the rate of exit and that of franking of the mailpieces.

* * * * *